US008678708B2

(12) United States Patent
Bond et al.

(10) Patent No.: US 8,678,708 B2
(45) Date of Patent: Mar. 25, 2014

(54) SUBSEA HYDROCARBON CONTAINMENT APPARATUS

(75) Inventors: Stanley Leroy Bond, Houston, TX (US); Allen Joseph Ginnard, Houston, TX (US); Jeffrey Paul Goetz, Houston, TX (US); Thomas Patrick Mataway, Spring, TX (US)

(73) Assignee: BP Corporation North America Inc., Houston, TX (US)

( * ) Notice: Subject to any disclaimer, the term of this patent is extended or adjusted under 35 U.S.C. 154(b) by 0 days.

(21) Appl. No.: 13/455,844

(22) Filed: Apr. 25, 2012

(65) Prior Publication Data

US 2012/0328373 A1 Dec. 27, 2012

Related U.S. Application Data

(60) Provisional application No. 61/479,128, filed on Apr. 26, 2011.

(51) Int. Cl.
*E02B 15/04* (2006.01)

(52) U.S. Cl.
USPC ..... 405/60

(58) Field of Classification Search
USPC ..... 405/60, 63, 64, 210; 166/364
See application file for complete search history.

(56) References Cited

U.S. PATENT DOCUMENTS

| | | | | |
|---|---|---|---|---|
| 1,859,606 | A * | 5/1932 | Sievern et al. | 166/79.1 |
| 4,309,127 | A * | 1/1982 | Jacobs | 405/60 |
| 4,318,442 | A * | 3/1982 | Lunde et al. | 405/60 |
| 4,358,218 | A * | 11/1982 | Graham | 405/60 |
| 4,382,716 | A * | 5/1983 | Miller | 405/60 |
| 4,395,157 | A * | 7/1983 | Cunningham | 405/60 |
| 4,416,565 | A * | 11/1983 | Ostlund | 405/210 |
| 4,447,247 | A * | 5/1984 | Naess | 405/60 |
| 4,449,850 | A * | 5/1984 | Cessou et al. | 405/60 |
| 4,456,071 | A * | 6/1984 | Milgram | 166/364 |
| 4,531,860 | A * | 7/1985 | Barnett | 405/60 |
| 4,568,220 | A * | 2/1986 | Hickey | 405/60 |
| 4,619,762 | A * | 10/1986 | Delacour et al. | 405/60 |
| 4,643,612 | A * | 2/1987 | Bergeron | 405/60 |
| 5,213,444 | A * | 5/1993 | Henning | 405/63 |
| 8,173,012 | B1 * | 5/2012 | Che | 405/60 |
| 8,186,443 | B2 * | 5/2012 | Wolinsky | 405/60 |
| 8,444,344 | B2 * | 5/2013 | Oesterberg et al. | 405/60 |
| 2005/0025574 | A1 * | 2/2005 | Lazes | 405/60 |
| 2011/0274493 | A1 * | 11/2011 | Cutts | 405/60 |
| 2012/0085276 | A1 * | 4/2012 | Openshaw et al. | 114/257 |
| 2012/0087729 | A1 * | 4/2012 | Oesterberg et al. | 405/60 |

FOREIGN PATENT DOCUMENTS

WO WO 2012/007357 A1 1/2012

* cited by examiner

*Primary Examiner* — Frederick L Lagman
(74) *Attorney, Agent, or Firm* — Jayne C. Piana

(57) ABSTRACT

A subsea hydrocarbon containment apparatus comprises a containment housing. In addition, the containment apparatus comprises a diverter plate mounted to the containment housing. The containment housing is configured to receive direct hydrocarbon fluids from a subsea hydrocarbon source and direct the hydrocarbon fluids to the diverter plate.

19 Claims, 7 Drawing Sheets

SUBSEA HYDROCARBON CONTAINMENT APPARATUS

CROSS-REFERENCE TO RELATED APPLICATIONS

This application claims domestic priority benefit under 35 U.S.C. §119(e) of U.S. provisional patent application Ser. No. 61/479,128 filed Apr. 26, 2011, and entitled "Subsea Hydrocarbon Containment Apparatus," which is hereby incorporated herein by reference in its entirety.

STATEMENT REGARDING FEDERALLY SPONSORED RESEARCH OR DEVELOPMENT

Not applicable.

BACKGROUND

1. Field of the Invention

The present disclosure relates generally to containment and disposal methods and systems in the marine hydrocarbon exploration, production, drilling and completion fields. More particularly, the disclosure relates to the field of subsea hydrocarbon containment. Still more specifically, the disclosure relates to suspended subsea hydrocarbon containment utilizing a modular containment apparatus and method. Embodiments of systems, methods, and apparatus disclosed herein may be fully or partially deployed before, during, and/or after a subsea leak has occurred, and may be used in any marine environment which contains equipment that is leaking or for which a leak is imminent or suspected to occur, particularly subsea regardless of water depth.

2. Background of the Technology

Conventional practice for containment and disposal methods and systems in the marine hydrocarbon exploration, production, drilling and completion fields, such as booms and skimmer vessels, may not be adequate for all circumstances. For example, booms and skimmer vessels are not designed to gather hydrocarbon fluids discharged from deep and ultra-deep subsea hydrocarbon production facilities. Industry experience with open-containment measures involving the capture of hydrocarbon flow in open water without latching or sealing has occurred in shallow water and involves relatively low fluid volumes. Prior open-containment efforts have not needed to address the fluid properties produced by the combination of the hydrocarbons, deep-ocean pressures and cold seawater that contribute to the formation of hydrocarbon gas hydrates.

Accordingly, there is a need in the art for mobile offshore containment apparatus and methods of use. Such apparatus would be particularly well-received if they were deployable from an offshore surface vessel, to a position suspended above a hydrocarbon breach, particularly at a substantial subsea depth. The need further includes a hydrocarbon containment apparatus, of a generally open construction, that can funnel a relatively large volume of discharged hydrocarbon fluids, regardless of the source of the breach.

BRIEF SUMMARY OF THE DISCLOSURE

These and other needs in the art are addressed in one embodiment by a subsea hydrocarbon containment apparatus. In an embodiment, the containment apparatus comprises a containment housing. In addition, the containment apparatus comprises a diverter plate mounted to the containment housing. The containment housing is configured to receive direct hydrocarbon fluids from a subsea hydrocarbon source and direct the hydrocarbon fluids to the diverter plate.

These and other needs in the art are addressed in another embodiment by a subsea hydrocarbon containment apparatus. In an embodiment, the containment apparatus comprises a lower housing including a peripheral wall defining an open inlet end configured to receive hydrocarbons from a subsea hydrocarbon source and an open outlet end configured to transfer hydrocarbons. In addition, the containment apparatus comprises an upper housing mounted to the lower housing. The upper housing including a peripheral wall defining an open inlet end configured to receive hydrocarbons from the outlet end of the lower housing. The upper housing includes a wellhead diverter plate mounted at an exit aperture of the upper housing. Further, the containment apparatus comprises a pressure control assembly mounted to the subsea wellhead diverter plate and configured to receive hydrocarbons from the exit aperture.

These and other needs in the art are addressed in another embodiment by a method of containing a subsea hydrocarbon source. In an embodiment, the method comprises deploying a fully assembled subsea containment apparatus from a surface vessel. The containment apparatus comprising a lower housing, an upper housing stacked onto the lower housing, a wellhead diverter plate mounted on the upper housing, and a pressure control assembly mounted to the wellhead hydrate diverter plate. In addition, the method comprises lowering the containment apparatus subsea with a pipestring coupled to the pressure control assembly. Further, the method comprises maneuvering the deployed containment apparatus to a position suspended above the hydrocarbon source. Still further, the method comprises purging the pressure control assembly from the surface to flush water from the pipestring. Moreover, the method comprises siphoning hydrocarbons from the containment components to the surface vessel.

Embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings. It is to be understood that both the foregoing general description and the following detailed description are exemplary and explanatory only, and are not restrictive of the invention, as claimed.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
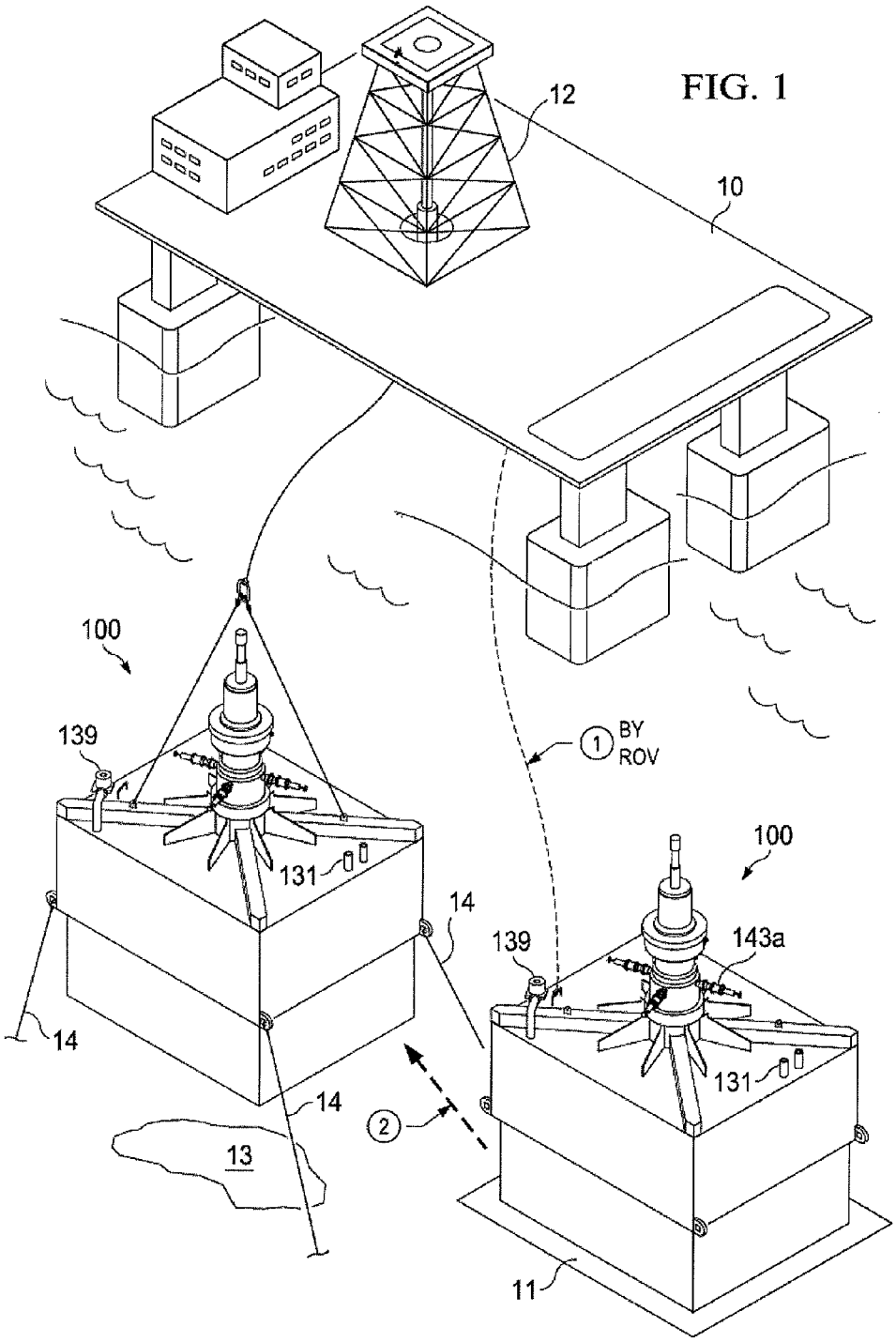
FIG. 1 is a perspective view depicting the deployment and positioning of an embodiment of an assembled hydrocarbon containment apparatus according to the principles described herein.

The following discussion is directed to various exemplary embodiments, examples of which are illustrated in the accompanying drawings. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. These embodiments are described in sufficient detail to enable those skilled in the art to practice the invention and it is to be understood that other embodiments may be utilized and that changes may be made without departing from the scope of the invention. The following description is, therefore, merely exemplary. In addition, it should be readily apparent to one of ordinary skill in the art that the apparatus and methods depicted in the drawings are generalized schematic illustrations and that other components or steps can be added or existing components or steps can be removed or modified.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness. Wherever possible, the same reference numbers will be used throughout the drawings to refer to the same or like parts.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. In addition, as used herein, the phrases "subsea source" and "subsea hydrocarbon source" include, but are not limited to: 1) drilling and production sources and equipment such as subsea wellheads, subsea blowout preventers (BOPs), other subsea risers, subsea trees, subsea manifolds, subsea piping and pipelines, subsea storage facilities, and the like, whether producing, transporting and/or storing gas, liquids, or combination thereof, including both organic and inorganic materials; 2) subsea containment sources and equipment of all types, including leaking or damaged subsea BOPs, risers, manifolds, tanks, and the like; and 3) subsea leaks or seeps, e.g. breaches, that can occur in the seabed floor.

Referring now to FIG. 1, the deployment of an embodiment of a hydrocarbon containment apparatus 100 is schematically shown. In this embodiment, containment apparatus 100 is deployed subsea in multiple stages. In a first deployment stage, labeled "1", containment apparatus 100 is lowered subsea from an offshore surface vessel 10, such as an offshore platform or drilling rig, to depth onto a landing pad 11 on the seafloor. A drillstring supported by derrick 12 on vessel 10 or wireline operated by a winch on vessel 10 can be used to lower apparatus during stage 1. In addition, one or more subsea ROVs known in the art may be utilized during stage 1 to facilitate deployment of apparatus 100. The initial deployment in stage 1 is preferably about 100 feet laterally offset from a subsea hydrocarbon source 13. In the second deployment stage, labeled "2", containment apparatus 100 is maneuvered subsea and suspended at a predetermined depth above source 13 (e.g., at a distance of about 100 feet) to capture and contain the discharged hydrocarbons within apparatus 100. The suspension of apparatus 100 is preferably performed with a drillstring or similar equipment such that the drillstring may also function to siphon and flow collected hydrocarbons from containment apparatus 100 to surface vessel 10 or other collection device. Once positioned above source 13, containment apparatus 100 is secured in position with restraints 14 extending between containment apparatus 100 and the seabed. In general, restrains 14 may comprise mooring lines, tie downs, cables, or the like. Restraints 14 are preferably sized and made of a material sufficient to maintain the suspended position of the fully assembled containment apparatus 100 over source 13. The staged deployment of containment apparatus 100 offers the potential to simplify readying and positioning of equipment as compared to deployment from directly above source 13.

As previously described, containment apparatus 100 is preferably deployed subsea, away from a hydrocarbon breach, and once at depth, moved quickly into position above source 13 to initiate the containment of hydrocarbons discharged from source 13. Containment apparatus 100 facilitates the capture of a relatively large volume of hydrocarbons while limiting the amount of seawater captured, thereby offering the potential to reduce the likelihood of hydrocarbon gas hydrate formations therein. In particular, containment apparatus 100 is preferably sized to have a containment volume of at least 1,000 cubic feet. It should be appreciated that containment apparatus 100 can be used to contain any type of subsea hydrocarbon source. In this embodiment, the total wet weight of containment apparatus 100 is less than 60 kips.

Figure 2:
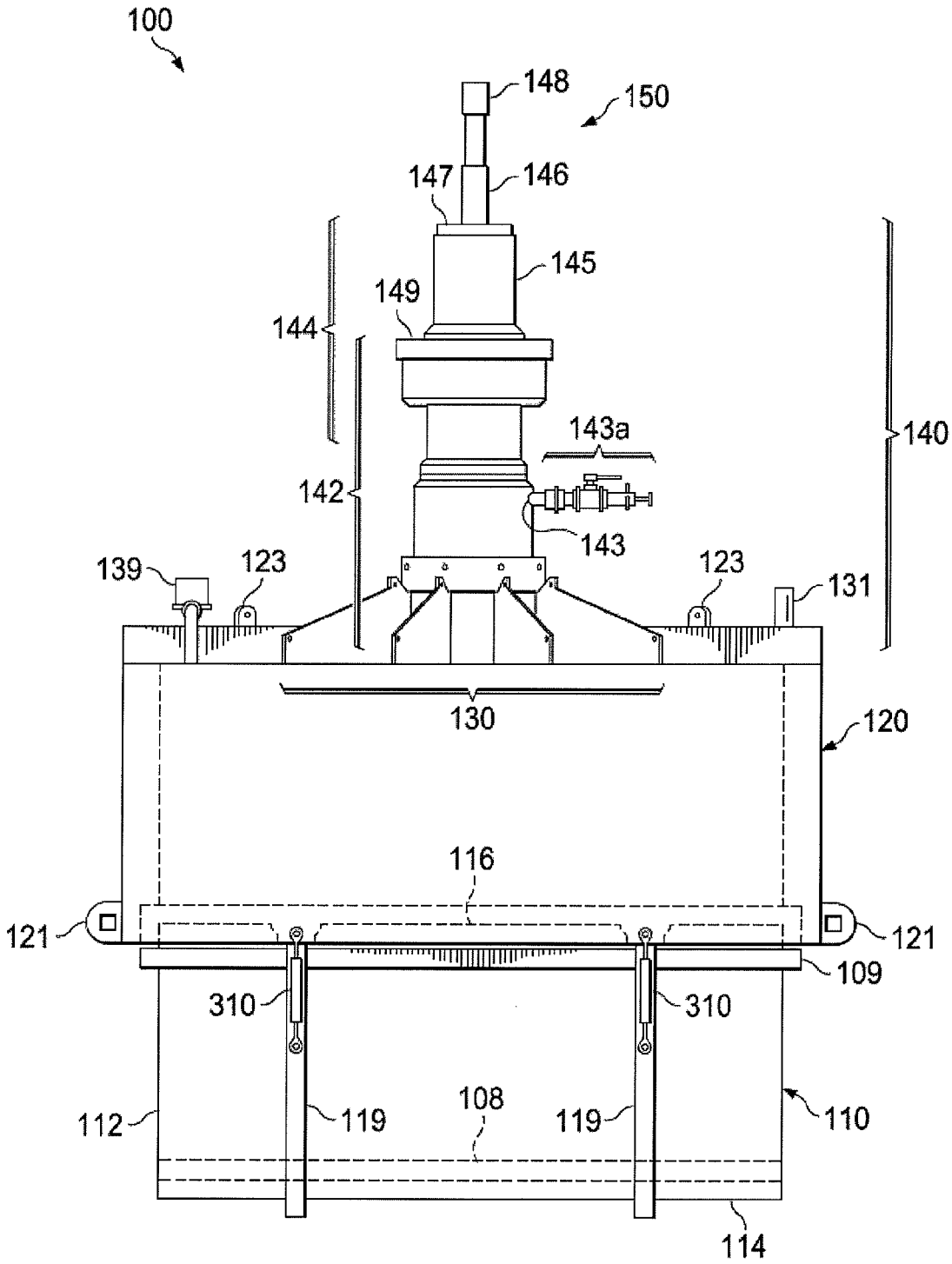
FIG. 2 is a side view of the assembled hydrocarbon containment apparatus of FIG. 1.

Referring now to FIG. 2, the fully assembled containment apparatus 100 is shown. In this embodiment, containment apparatus 100 includes a lower or base housing 110, an upper housing 120 generally disposed about and coupled to lower housing 110, a wellhead diverter plate 130 incorporated into the top of upper housing 120, a pressure control assembly 140 mounted to the diverter plate 130, and a collection apparatus 150 connected to pressure control assembly 140. Housings 110, 120 plate 130, assembly 140, and apparatus 150 can be made of any material suitable for subsea deployment over extended periods of time including, without limitation, carbon steels, low-alloy steels, and stainless steels.

Figure 3:
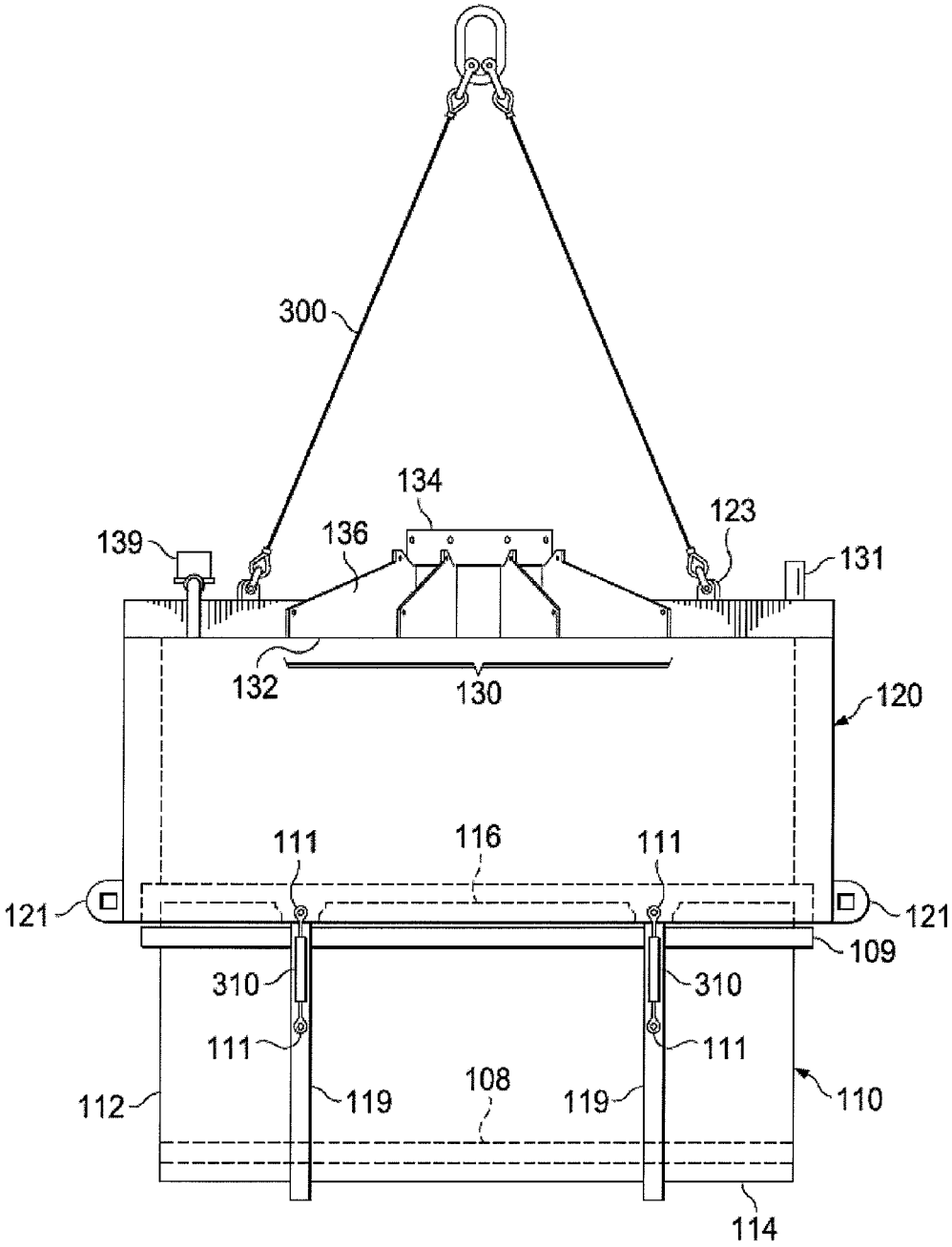
FIG. 3 is a side view of the assembled lower and upper housings of the containment apparatus of FIG. 1.
Figure 4:
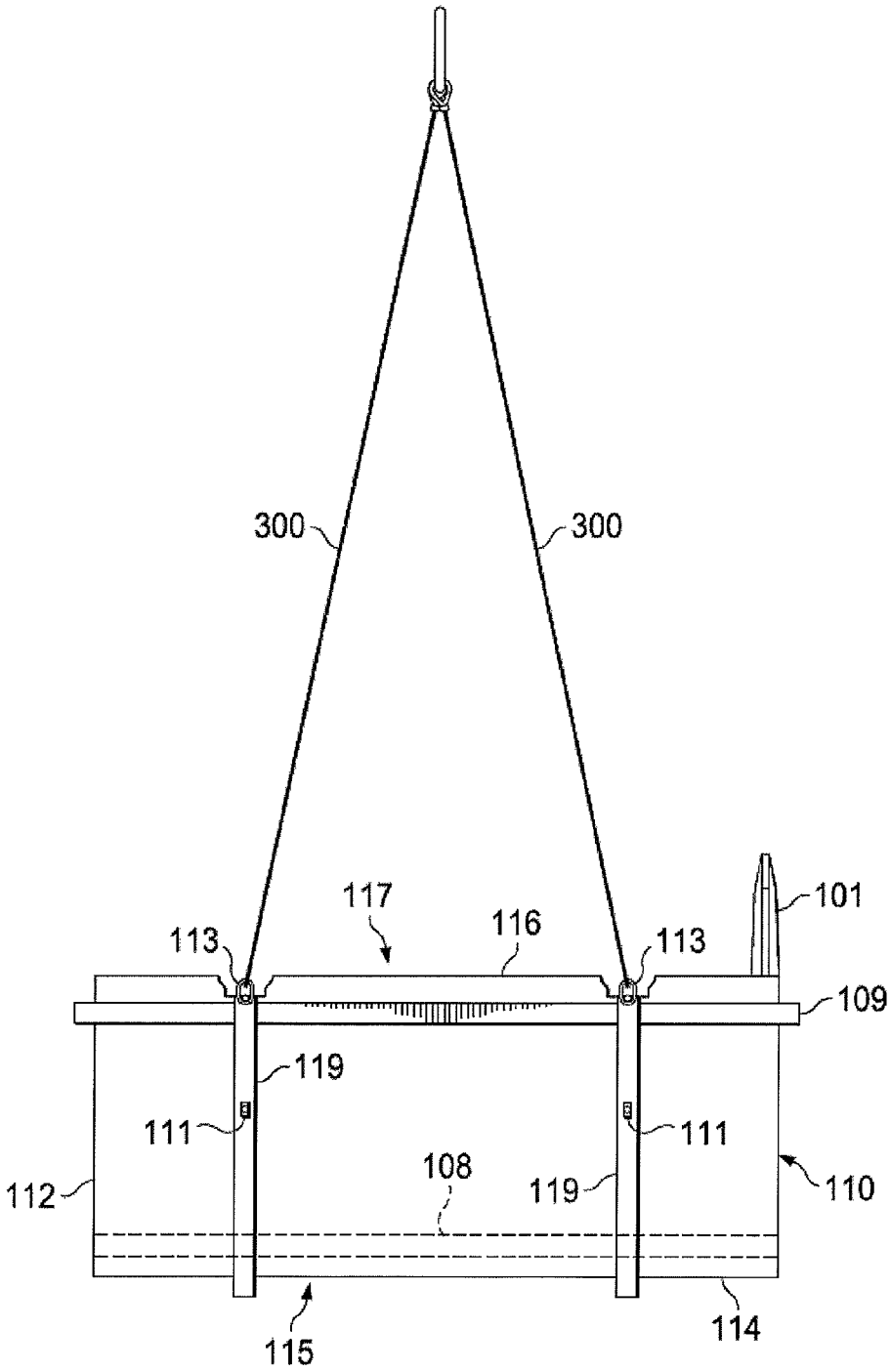
FIG. 4 is a side view of the lower housing of the containment apparatus of FIG. 1.
Figure 5:
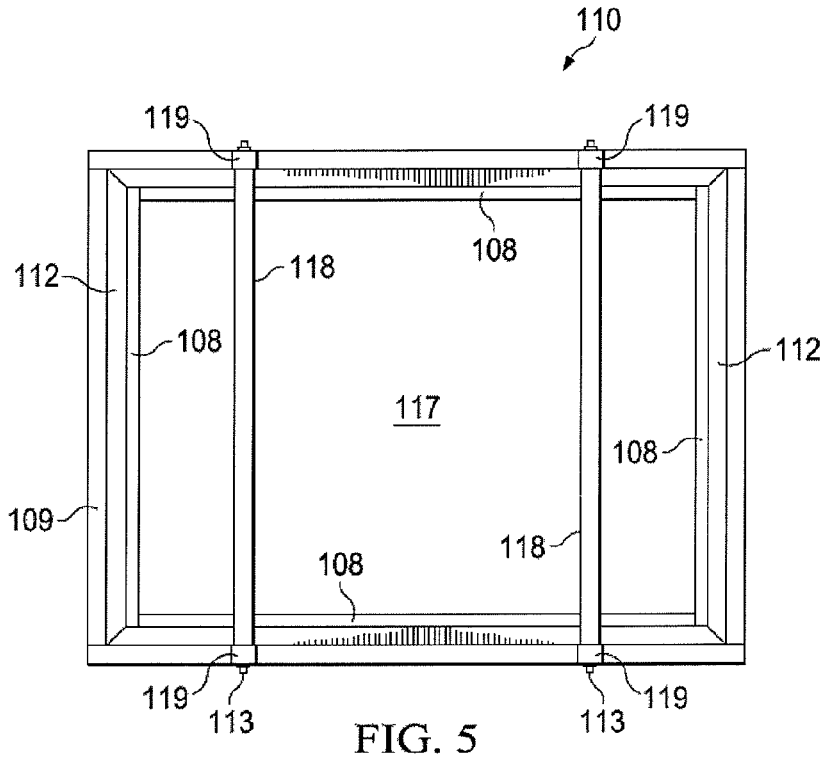
FIG. 5 is a top view of the lower housing of FIG. 4.

Referring now to FIGS. 2 and 3, the assembled lower housing 110 and upper housing 120 of containment apparatus 100 are shown. As best shown in FIGS. 3-5, lower housing 110 includes a rectangular peripheral wall 112 having a lower end 114 and an upper end 116 opposite end 114. Peripheral wall 112 defines a fluid receptacle and flow passage extending through housing 110 from an inlet opening 115 at lower end 114 and an outlet opening 117 at upper end 116. In general, hydrocarbons captured by containment apparatus 100 flow into lower housing 110 at inlet opening 115 and out of housing 110 at outlet opening 117. The hydrocarbons inherently flow in a generally upward direction into and through housing 110 since hydrocarbons have a lower density than the surrounding seawater, and thus, rise from source 13 toward the sea surface.

Although wall 112 and lower housing 110 are rectangular in this embodiment, other shapes are contemplated as being within the scope of this disclosure. For example, the lower housing (e.g., lower housing 110) can be in the shape of an ellipse, circle, square, or other suitable shape. It will be appreciated that the rectangular shape depicted herein can be a function of the availability of containment hardware and equipment on short notice as well as its ability to be easily transported on existing transport equipment.

In this embodiment, lower housing 110 also includes an inner peripheral reinforcing band 108 extending horizontally along the inside of wall 112 and an outer peripheral reinforcing band 109 extending horizontally along the outside of wall 112. Vertically spaced bands 108, 109 are securely attached to wall 112 and provide rigidity and strength to lower housing 110. In this embodiment, inner reinforcing band 108 is positioned adjacent lower end 114 of housing 110 and outer reinforcing band 109 is positioned adjacent upper end 116 of lower housing 110. Further rigidity and strength are provided by a support structure comprising a pair of laterally spaced horizontal cross beams 118 mounted to a pair of laterally spaced vertical wall beams 119. Vertical wall beams 119 are attached to the outside of wall 112 and cross-beams 118 extend across outlet opening 117 between the upper ends of wall beams 119. Although beams 119 are depicted on the outside of wall 112 in this embodiment, in other embodiments, the vertical beams (e.g., beams 119) are disposed along the inside of the peripheral wall (e.g., wall 112). Beams 118, 119 and bands 108, 109 can attached to wall 112 by any suitable means including, without limitation, a welded connection, a bolted connection, or the like. In an exemplary embodiment, lower housing 110 is about 20 feet long, about 16 feet wide, and the two cross beams 118 span the 16 foot width and are laterally spaced about 10 feet apart.

As best shown in FIG. 4, lower housing 110 is also provided with a plurality of connection members including padeyes 111 and shackles 113. In particular, one shackle 113 is coupled to each vertical wall beam 119 proximal upper end 116 of housing 110. A wire rope sling 300 is hooked to the four shackles 113 to lift and maneuver lower housing 110 during assembly of containment apparatus 100. One padeye 111 is attached to each vertical wall beam 119 at about mid-height of wall 112, generally vertically aligned with one padeye 121 on upper housing 120 as will be described in more detail below. A pair of padeyes 111 is preferably provided on each side of the four sided wall 112; however, any suitable number of padeyes 111 can be used. For example, only two opposing sidewalls of wall 112 can include a pair of padeyes 111. Padeyes 111 can be attached to beams 119 or wall 112 with any suitable means including, without limitation, a welded connection, bolted connection, or the like. An alignment member 101 is coupled to the inside of one corner of wall 112 and extends upward therefrom through opening 117. During assembly of containment apparatus 100, member 101 is employed to align housings 110, 120.

Referring now to FIGS. 2, 3, and 6-8, upper housing 120 includes a rectangular peripheral wall 122 having a lower base end 124 and an upper end 126 opposite the base end 124. Wall 122 defines an inlet opening 125 at base end 124. Opening 125 is dimensioned (i.e., has a length and width) substantially the same as the outside of peripheral wall 112, and further, is aligned with outlet opening 117 upon assembly of containment apparatus 100. A horizontal wall 127 generally closes upper end 126 of housing 120. Diverter plate 130 is mounted to wall 127 and defines a flow path through wall 127.

Although wall 122 and upper housing 120 are rectangular in this embodiment, other shapes are contemplated as being within the scope of this disclosure. For example, the upper housing (e.g., upper housing 120) can be in the shape of an ellipse, circle, square, or other suitable shape. It will be appreciated that the rectangular shape depicted herein can be a function of the availability of containment hardware and equipment on short notice as well as its ability to be easily transported on existing transport equipment. In embodiments described herein, lower housing 110 and upper housing 120 are preferably of similar shapes to ensure a seamless coupling of housings 110, 120 via sliding receipt of upper end 116 of lower housing 110 into opening 125 of upper housing 120.

Figure 6:
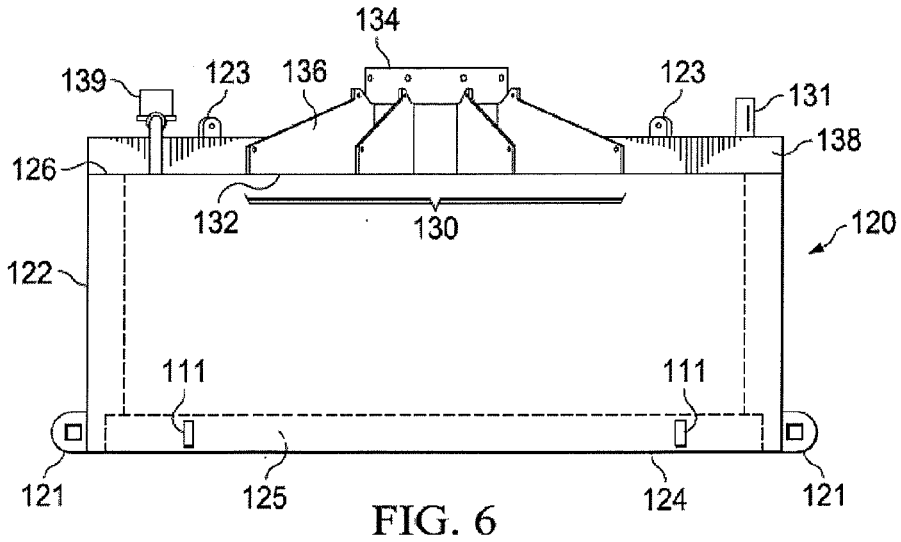
FIG. 6 is a side view of the upper housing of the containment apparatus of FIG. 1.

As best shown in FIG. 6, diverter plate 130 includes a horizontal plate portion 132 fixed to upper wall 127, a vertical conduit 134 extending vertically upward from and integrally formed with plate portion 132, and reinforcing webs or fins 136 extending between the vertical conduit 134 and plate portion 132. Radial beams 138 extend radially across upper wall 127 between conduit 134 and the peripheral edge of wall 126. In the case of an exemplary rectangular upper housing 120, each of four radial beams 138 span a distance between the vertical conduit 134 and each corner of wall 126.

Figure 7:
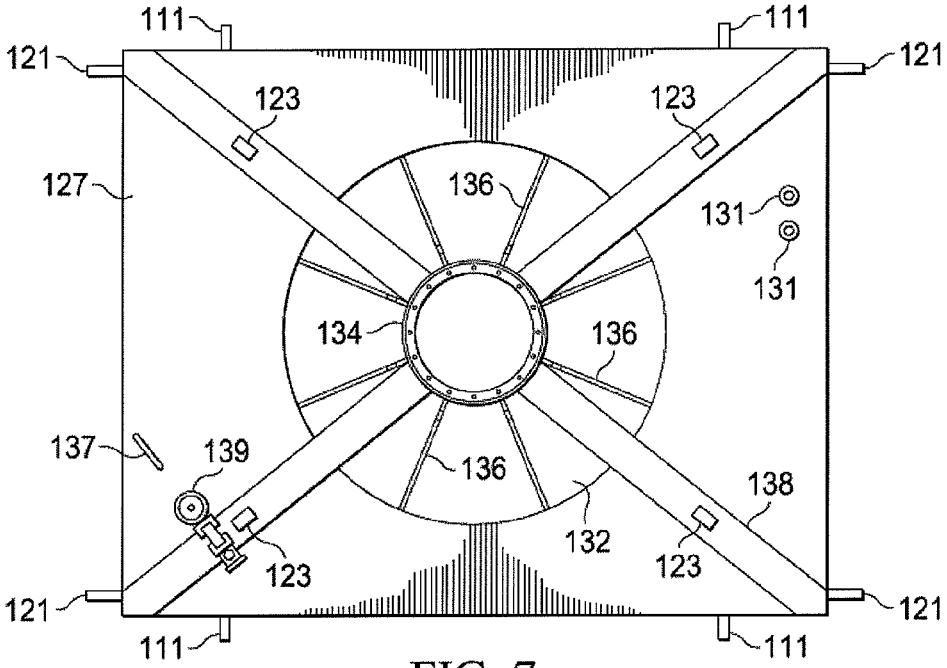
FIG. 7 is a top view of the upper housing of the containment apparatus of FIG. 1.

As best shown in FIGS. 3, 6, and 7, upper housing 120 is provided with a plurality of connection members including shackles 123 and padeyes 121. One shackle 123 is coupled to each beam 138 and is positioned to enable a balanced lift of upper housing 120 during assembly and/or deployment of containment apparatus 100. Wire rope sling 300 is hooked to the four shackles 123 to lift and maneuver upper housing 120. Padeyes 121 are coupled to wall 122 and are configured to receive restraints 14 for mooring apparatus 100 in position over source 13. Shackles 123 and padeyes 121 may be coupled to upper housing 120 by any suitable means including, without limitation, welded connections, bolted connections, or the like.

As best shown in FIGS. 3 and 6-8, upper housing 120 also include a plurality of padeyes 111 positioned at base end 124. In particular, padeyes 111 of upper housing 120 are positioned to be in vertical alignment with padeyes 111 of lower housing 120 upon assembly of containment apparatus 100. As shown in FIG. 3, a turnbuckle 310 is positioned and tightened between each pair of aligned padeyes 111 on the lower and upper housings 110, 120, respectively. Upon securing turnbuckle 310, the lower and upper housing 110, 120 are coupled together for use.

Figure 8:
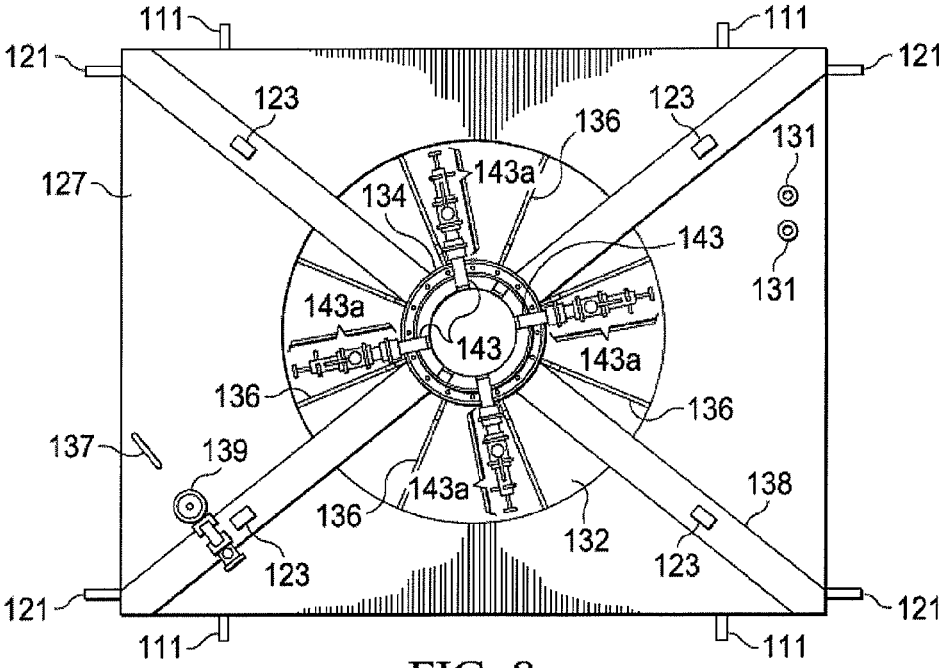
FIG. 8 is a top view of the upper housing and the pressure control assembly of the containment apparatus of FIG. 1.

As best shown in FIG. 8, upper housing 120 also includes at least one ROV grab handle 137, a hot stab receptacle 139 including an isolation valve (e.g., an ROV operated ball valve), and a pair of access ports 131. Handles 137 extend upward from upper wall 127 and are configured to be grasped by one or more subsea ROVs to position and maneuver apparatus 100 during deployment and collection operations. Hot stab receptacle 139 and ports 131 are also provided on upper wall 127. In general, receptacle 139 and ports 131 are used to inject fluids (e.g., hydrate inhibiting chemicals) into apparatus 100 or receive fluids from apparatus 100. In this embodiment, plugs are disposed in ports 131, thereby preventing fluid flow therethrough. However, as desired, the plug(s) can be removed and fluid conduits or hoses attached to ports 131 to supply or receive fluids. For example, ports 131 may be hard plumbed to allow controlled injection of hydrate inhibiting fluids from the surface.

Referring now to FIGS. 2 and 8, pressure control assembly 140 includes a fabricated joint section low pressure conduit or housing 142, a fabricated joint section high pressure conduit or housing 144 coupled to housing 142 and extending coaxially therefrom, a running tool 146, and drill pipe 148. As is known in the art, a low pressure housing is a common industry description of a conductor housing in accordance with API 17D specifications such as is employed in the top connection on the outermost casing string set in the seabed; and a high pressure housing is a common industry description of a wellhead housing in accordance with API 17D specifications such as is employed on top of the casing in the seabed.

The lower end of low pressure housing 142 is mounted within vertical conduit 134. Connection of low pressure housing 142 to vertical conduit 134 can be by ring latches or the like to provide a fluid tight fit therebetween. Low pressure housing 142 also includes a deep swallow support plate and rotary table assembly 149 and a plurality of circumferentially spaced ports 143 extending radially therethrough. Each port 143 is fitted with a valve assembly 143*a* including a valve that controls the flow of fluids through the corresponding port 143. In this embodiment, the valves in assemblies 143*a* are ball valves. As will be described in more detail below, assemblies 143*a* and ports 143 enable the injection of fluids (e.g., hydrate inhibiting chemicals) into apparatus 100 and the sampling or production of fluids from apparatus 100.

In this embodiment, high pressure housing 144 is formed of wellhead housing 145 without flow-by. Connection of high pressure housing 144 to low pressure housing 142 can be by threading, ring latches, or the like to provide a fluid tight fit therebetween. A stop plate 147 is mounted on the upper end of high pressure housing 144 as shown.

Running tool 146 is connected to the high pressure housing 144, and lengths of drill pipe 148 are coupled thereto using an external wellhead connector to reach an overall length suitable to deploy containment apparatus 100 to a subsea depth at which containment is needed. For example, drill pipe 148 can be added to deploy containment apparatus 100 to a subsea depth of about 4,000 feet or more. It is to be understood that the depth given is by way of example only and that any depth can be obtained by adding lengths of drill pipe 148.

Assembly of containment apparatus 100, whether on-site or off-site, includes multiple steps such as positioning one of the moonpool carts in the forward port corner of the moonpool (or identify where on the boat deck to stack the boxes); attaching sling 300 to lower housing 110 via shackles 113; picking up lower housing 110 with sling 300 and landing lower housing 110 on the staged cart so that the 16' width is port to starboard and the 20' length is forward to aft; connecting a tie down to each of four upper padeyes 111 on lower housing 110 and then tying them off on the cart (or boat deck); removing sling 300 from lower housing 110; inspecting the top of lower housing 110 to ensure no damage; attaching tag lines to bottom padeyes 121 on upper housing 120 to assist in alignment operations; picking up upper housing 120 using shackles 123 and sling 300; ensuring that the upper and lower housing 110, 120 are aligned (e.g., by aligning markings on the upper and lower housings 110, 120 and inserting alignment member along the inner corner of wall 121 in lower opening 125); landing upper housing 120 onto lower housing 110; visually verifying that upper housing 120 is fully landed onto lower housing 110 and cross beams 118 on both sides; securing upper housing 120 to lower housing 110 with turnbuckles 310; and installing a shackle on one end of each turnbuckle 310 to assist with any fabrication tolerances between the aligned padeyes 111 of housings 110, 120; and sufficiently tightening turnbuckles 310 to ensure turnbuckles 310 do not back-off in service. Assembly also includes installing one or more ROV hot stab receptacles 139 in the top of upper housing 120 and ports 131 for injected chemicals or receiving fluids from housing 120; ensuring that ROV hot stab receptacle 139 and associated isolation valve are secured and undamaged; confirming that the isolation valve associated with receptacle 139 is closed; releasing the crane from upper housing 120, without removing sling 300; and transporting the cart supporting the assembled containment apparatus 100 to the edge of the aft moon pool.

Running tool staging prior to deployment of apparatus 100 includes making up the housing running tool 146; making up the crossover sub to drill pipe 148; removing the stop plate from housing running tool 146; and racking back the housing running tool 146. The stop plate and cap screws can be kept on hand for re-installation after make-up to housing. To initiate deployment, the running tool 146 is picked up by the rig at the surface and run without having to wait to thread all the parts together.

Figure 9:
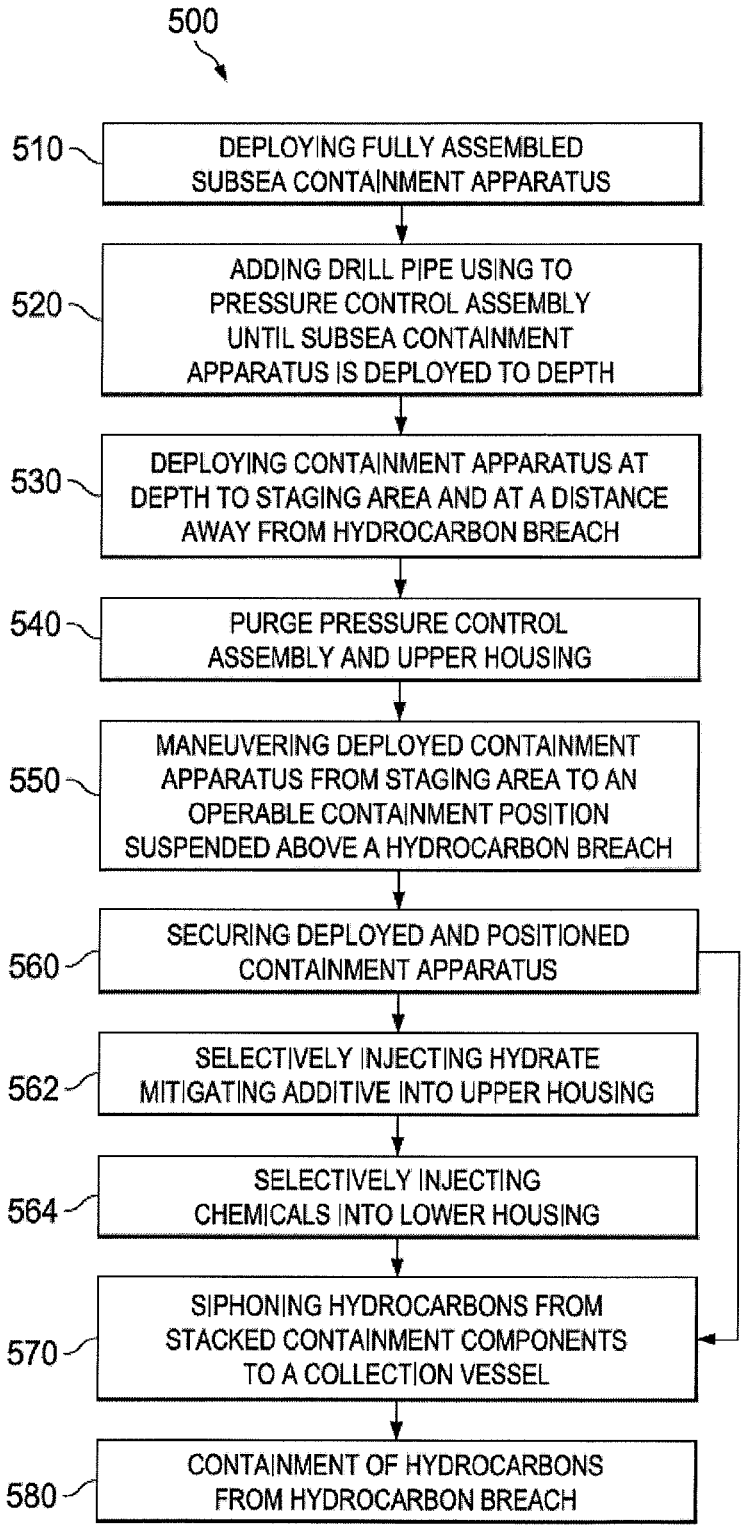
FIG. 9 is a schematic flow diagram of an embodiment of a method for assembling and deploying the containment apparatus of FIG. 1 in accordance with the principles described herein.

Referring now to FIG. 9, an embodiment of a method 500 for deploying the fully assembled subsea containment apparatus 100 is shown. In this embodiment, the fully assembled subsea containment apparatus 100 includes stacked housings 110, 120 as previously described configured to direct hydrocarbons discharged from source 13 to diverter plate 130 mounted to upper housing 120, and the pressure control assembly 140 mounted to diverter plate 130. It will be appreciated that the deployable containment apparatus 100 can first be assembled, as previously described, either off-site for transport to a rig, particularly the moonpool of the rig, or can be fully assembled on-site, for example at the moonpool of the rig.

The assembled containment apparatus 100 is lowered subsea through the moonpool of a surface vessel in step 510. Drill pipe 148, e.g. extraction piping, is added and coupled to the pressure control assembly 140 in step 520 until containment apparatus 100 is deployed to depth. Moving now to step 530, and as shown in FIG. 1 (stage "1"), containment apparatus 100 is first deployed to a staging area, either on the seabed or at another predetermined depth and at a distance away from the subsea hydrocarbon source 13, whether it is an equipment leak or seabed leek or seep. The staging area can be, for example, about 600 feet away from source 13. Containment apparatus 100 can be staged on mudmats 11 placed on the seabed so that the main beams 119 of lower housing 110 are the only structures that come in contact with mudmats 11.

Next, in step 540, the pressure control assembly 140 and upper housing 120 are purged by pumping a fluid, such as a hydrate inhibiting chemical, heated water, nitrogen gas, or combinations thereof, from the surface through pipe 148, assembly 140, and housing 120 to reduce the potential for hydrate formation therein. During or after purging pressure control assembly 140 and upper housing 120, containment apparatus 100 is maneuvered from the staging area to an operable containment position suspended above a hydrocarbon breach in step 550 and as shown in FIG. 1 (stage "2"). One or more subsea ROVs may be employed to assist in positioning containment apparatus 100. In step 560, the deployed and positioned containment apparatus 100 is secured in position above the breach with, for example, restraints 14 extending from containment apparatus 100 (e.g., using padeyes 121) to the seabed or existing subsea hardware. Upon full deployment, containment apparatus 100 is suspended at a predetermined distance above source 13, for example about 100 feet above source 13. Moving now to step 570, hydrocarbons are siphoned through containment apparatus 100 and drill pipe 148 to a collection vessel at the surface.

During hydrocarbon capture and collection operations, hydrate inhibiting chemicals/additives are preferably injected into upper housing 120 via one or more injection ports (e.g., ports 143, ports 131, hot stab receptacle 139, or combinations thereof) in step 562. The method further includes injecting chemicals into upper housing 120 and lower housing 110 via ports 143 and/or hot stab receptacle 139 in step 564. The method concludes at step 580 with containment of hydrocarbons from the hydrocarbon breach. Although hydrate inhibiting chemicals are preferably injected in steps 562, 564, these steps can be skipped.

Deployment of containment apparatus 100 includes certain steps of, for example, making-up a housing running tool 146 that is racked back in to upper housing 120; securing the housing running tool 146 with the stop plate 147 and two cap screws; and using draw works, raising the assembly from the rotary and removing the LP housing support plate; running the housing assembly through the rotary; making up ball valve assemblies to the adapter; ensuring use of upper elevation of outlets to allow as much room as possible for retainer sleeve; orienting valves such that the valve stem is on top of the assembly; mounting valve handles such that the open handle position for open is parallel to the main pipe (e.g., 4" pipe) coming outward; ensuring that ball valves are closed; making up NPT blind plugs as necessary to blank off remaining outlet ports not used by valve assemblies; raising the housing assembly above the top of containment apparatus; landing the first stand in rotary slips; installing a back up clamp on the pipe; transporting the cart until the center of the containment apparatus is under the well center; lowering the housing assembly into the diverter interface to an elevation where the pipe centralizer fins are fully engaged into the ID of the diverter; attaching to the latch ring support ring swivel lift eyes to raise it up onto the adapter; removing the snap ring 'belt buckle' ferry head cap screw to allow snap ring to expand; ensuring that the diverter snap ring is opened using the provided bolts; landing the housing assembly into the upper housing/hydrate diverter interface; removing the bolts for snap ring to close around the adapter landing ring; re-installing the split ring belt buckle and ferry head cap screws to secure snap ring in closed position; lowering the latch ring support ring over the split ring and securing; removing the swivel lift eyes from the latch ring support ring; releasing the lower housing sea fastening from the cart; raising the drill pipe to clear lower housing 110 from the cart; and moving the cart out of the moon pool and spread beams to past the containment apparatus.

As previously described, in operation, containment apparatus 100 is suspended from the bottom of the drill pipe 148 (or a riser string), and positioned over source 13 (e.g., a leaking well, leaking subsea equipment, or seep) to facilitate capture and containment of the discharged hydrocarbons. With containment apparatus 100 positioned over source 13, the discharged hydrocarbons flow into containment apparatus 100 through opening 115 at the base end 114 and accumulate within containment apparatus 100, in both lower housing 110 and upper housing 120. The drill pipe 148 is then purged from the surface to displace water out of the drill pipe 148 and upper housing 120, such that the drill pipe 148 becomes pressurized and no flow is allowed into pipe 148 from upper housing 120. Upon opening a surface valve in the topside collection piping, pressure control assembly 140 and drill pipe 148 siphon mostly hydrocarbons up the drill pipe 148 to a hydrocarbon collector assembly, such as a ship, or other known collection facility at the surface.

In general, containment apparatus 100 can be made as large as possible while still being deployable from an offshore vessel, for example a drill ship, mobile offshore drilling unit (MODU), or the like. It will be appreciated that more than two stacked housing components (e.g., housings 110, 120) can be utilized, with the number of housing components proportionally increasing the volume of hydrocarbons "funneled" subsea from a breach. The large housing components offer the potential to allow for most of the hydrocarbons to be gathered and keep the seawater out of the riser to prevent hydrates from forming.

While this assembly was built from existing equipment that comprised a hydrate diverter and high pressure/low pressure housing components, the design intent of each can be integrated into a purpose built assembly that would not necessarily mandate these components be prefabricated as initially defined herein, but designed as purpose-built components to minimize weight, size, leak paths and offshore handling, while maintaining similar functional attributes.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume values as defined earlier plus negative values, e.g. −1, −1.2, −1.89, −2, −2.5, −3, −10, −20, −30, etc.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A subsea hydrocarbon containment apparatus, comprising:

a containment housing; and a diverter plate mounted to the containment housing;

wherein the containment housing is configured to receive direct hydrocarbon fluids from a subsea hydrocarbon source and to direct the hydrocarbon fluids to the diverter plate;

a pressure control assembly mounted to the diverter plate;

wherein the pressure control assembly includes a high pressure housing and a low pressure housing coupled to the high pressure housing; and wherein the pressure control assembly is configured to receive the hydrocarbon fluids from the containment housing.

2. The apparatus of claim 1, further comprising a hydrocarbon collection assembly mounted to the pressure control assembly and configured to receive the hydrocarbon fluids from the pressure control assembly.

3. The apparatus of claim 2, wherein the hydrocarbon collection assembly comprises a drill pipe or a riser.

4. The apparatus of claim 2, wherein the apparatus is configured to be suspended subsea by the hydrocarbon collection assembly.

5. The apparatus of claim 1, wherein the containment housing comprises a lower housing coupled to an upper housing, wherein the upper housing is stacked onto the lower housing.

6. The apparatus of claim 1, wherein the containment housing comprises a containment volume of at least about 1,000 cubic feet.

7. A subsea hydrocarbon containment apparatus comprising:

a lower housing including a peripheral wall defining an open inlet end configured to receive hydrocarbons from a subsea hydrocarbon source and an open outlet end configured to transfer hydrocarbons;

an upper housing mounted to the lower housing, the upper housing including a peripheral wall defining an open inlet end configured to receive hydrocarbons from the outlet end of the lower housing, wherein the upper housing includes a wellhead diverter plate mounted at an exit aperture of the upper housing; and a pressure control assembly mounted to the subsea wellhead diverter plate and configured to receive hydrocarbons from the exit aperture;

wherein the pressure control assembly comprises a high pressure housing and a low pressure housing sealingly coupled to the high pressure housing.

8. The apparatus of claim 7, wherein the peripheral wall of the upper housing has an inner dimension substantially corresponding to an outer dimension of the peripheral wall of the lower housing.

9. The apparatus of claim 7, further comprising a drill pipe coupled to the high pressure housing with a running tool.

10. The apparatus of claim 7, further comprising a riser connected to the high pressure housing with an external wellhead connector.

11. The apparatus of claim 7, wherein the lower housing comprises a pair of spaced cross beams spanning the open outlet end, and wherein the upper housing is seated on the pair of spaced beams of the lower housing.

12. The apparatus of claim 7, wherein the upper housing comprises a plurality of injection inlets configured to inject a hydrate inhibiting fluid into the upper housing.

13. The apparatus of claim 7, wherein the upper housing is coupled to the lower housing with a plurality of turnbuckles.

14. The apparatus of claim 7, further comprising a plurality of restraints coupled to the upper housing and configured to maintain the apparatus in a position above the hydrocarbon source.

15. A method of containing a subsea hydrocarbon source, the method comprising:

deploying a fully assembled subsea containment apparatus from a surface vessel, the apparatus comprising a lower housing, an upper housing stacked onto the lower housing, a wellhead diverter plate mounted on the upper housing, and a pressure control assembly mounted to the wellhead hydrate diverter plate;

lowering the apparatus subsea with a pipestring coupled to the pressure control assembly;

maneuvering the deployed apparatus to a position suspended above the hydrocarbon source;

purging the pressure control assembly from the surface to flush water from the pipestring; and siphoning hydrocarbons from the apparatus to the surface vessel;

wherein the pressure control assembly includes a high pressure housing and a low pressure housing.

16. The method of claim 15, further comprising suspending the apparatus about 100 feet above the source.

17. The method of claim 16, wherein maneuvering the deployed containment apparatus comprises positioning the apparatus in a first subsea position away from the hydrocarbon source, and moving the apparatus from the first position to a second position over the source.

18. The method of claim 15, further comprising securing the deployed and positioned containment apparatus with a plurality of restraints extending from the apparatus to the sea floor.

19. The method of claim 15, further comprising injecting hydrate inhibiting chemicals into the apparatus through a plurality of injection ports in the upper housing.

* * * * *